US007883178B2

(12) United States Patent
Koike et al.

(10) Patent No.: US 7,883,178 B2
(45) Date of Patent: Feb. 8, 2011

(54) LIQUID EJECTING APPARATUS

(75) Inventors: Kaoru Koike, Matsumoto (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 99 days.

(21) Appl. No.: 12/371,231

(22) Filed: Feb. 13, 2009

(65) Prior Publication Data

US 2009/0207205 A1 Aug. 20, 2009

(30) Foreign Application Priority Data

Feb. 15, 2008 (JP) ..... 2008-034815

(51) Int. Cl.
*B41J 2/165* (2006.01)

(52) U.S. Cl. ..... 347/36; 347/31; 347/35

(58) Field of Classification Search ..... 347/29, 347/30, 31, 32, 35, 36
See application file for complete search history.

(56) References Cited

FOREIGN PATENT DOCUMENTS

| | | | |
|---|---|---|---|
| JP | 59115863 | * | 7/1984 |
| JP | 06-166175 | | 6/1994 |
| JP | 2003-341158 | * | 12/2003 |
| JP | 2006-239871 | | 9/2006 |
| JP | 2007-296835 | | 11/2007 |
| JP | 2007-301756 | | 11/2007 |
| JP | 2008-006768 | | 1/2008 |

* cited by examiner

*Primary Examiner*—Shih-wen Hsieh
(74) *Attorney, Agent, or Firm*—Workman Nydegger

(57) ABSTRACT

A liquid ejecting apparatus comprising nozzles capable of ejecting a liquid onto a medium, a rotational drum including a circumferential surface having a holding area for holding the medium and a non-holding area provided with an opening, wherein the circumferential surface rotates while facing the nozzles, and an absorptive drum which is provided inside the rotational drum which is capable of absorbing the liquid ejected from the nozzles toward the opening of the outer circumference in order to perform a flushing operation.

6 Claims, 8 Drawing Sheets

LIQUID EJECTING APPARATUS

BACKGROUND OF THE INVENTION

The entire disclosures of Japanese Patent Application No. 2008-034815, filed Feb. 15, 2008 is expressly incorporated herein by reference.

1. Technical Field

The present invention relates to a liquid ejecting apparatus. More specifically, the present invention relates to a liquid ejecting apparatus including nozzles which ejects a liquid onto a medium and a rotational drum which has a circumferential surface having a holding area for holding the medium and a non-holding area, wherein the rotational drum rotates so that the circumferential surface faces the nozzles.

2. Related Art

One example of a liquid ejecting apparatus known in the art includes nozzles which eject a liquid onto a medium, where the apparatus includes a rotational drum which has a circumferential surface having a holding area for holding the medium and a non-holding area. The rotational drum rotates while the circumferential surface faces the nozzles. An opening is formed in the non-holding area of the circumferential surface of the rotational drum. In this liquid ejecting apparatus, a liquid is ejected toward the opening from the nozzles to perform a flushing operation. In addition, an absorptive member capable of absorbing the liquid ejected toward the opening from the nozzles during the flushing operation is provided in the rotational drum. One example of such an apparatus is described in Japanese Patent Pub. No. JP-2006-239871.

One problem with this configuration, however, is that when the absorptive member absorbs the liquid ejected toward the opening from the nozzles during a flushing operation, the absorptive member may affect the rotation of the rotational drum. For example, when the absorptive member is provided in the rotational drum, the liquid is absorbed in only one area, causing a weight imbalance in the rotational drum, which may cause problems with the rotation of the rotational drum.

BRIEF SUMMARY OF THE INVENTION

An advantage of some aspects of the invention is that it provides a liquid ejecting apparatus capable of absorbing a liquid ejected from nozzles to perform flushing without causing a trouble with rotation of a rotational drum.

A first aspect of the invention is a liquid ejecting apparatus comprising nozzles capable of ejecting a liquid onto a medium, a rotational drum including a circumferential surface having a holding area for holding the medium and a non-holding area provided with an opening, wherein the circumferential surface rotates while facing the nozzles, and an absorptive drum which is provided inside the rotational drum which is capable of absorbing the liquid ejected from the nozzles toward the opening of the outer circumference in order to perform a flushing operation.

A second aspect of the invention is a method of performing a flushing operation in a liquid ejecting apparatus including nozzles capable of ejecting a liquid onto a medium, a rotational drum including a circumferential surface having a holding area for holding the medium and a non-holding area provided with an opening, and an absorptive drum which is provided inside the rotational drum. The method comprises rotating the rotational drum so that the circumferential surface faces the nozzles until the nozzles face the opening of the non-holding area of the outer circumference, ejecting the liquid toward the opening from the nozzles, and absorbing the liquid at an exposure position of the absorptive drum which exposed to the nozzles by the opening of the circumferential surface of the rotational drum.

Other aspects of the invention are apparent from the specification and the accompanying drawings of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
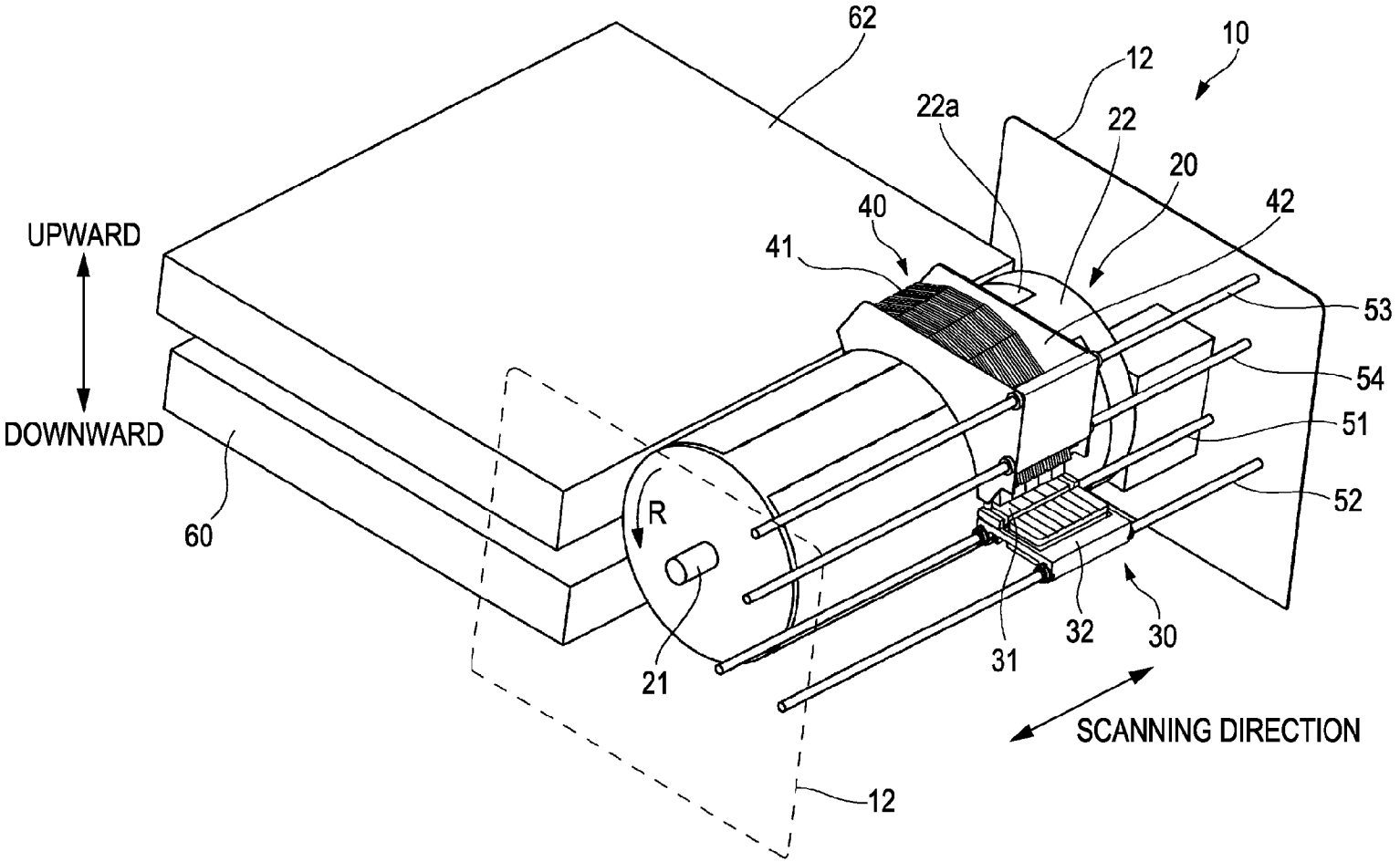
FIG. 1 is a schematic perspective view illustrating the structure of a printer.

Aspects described below are apparent from disclosure of the specification and disclosure of the accompanying drawings of the invention.

One aspect of the invention is a liquid ejecting apparatus comprising nozzles capable of ejecting a liquid onto a medium, a rotational drum including a circumferential surface having a holding area for holding the medium and a non-holding area provided with an opening, wherein the circumferential surface rotates while facing the nozzles, and an absorptive drum which is provided inside the rotational drum which is capable of absorbing the liquid ejected from the nozzles toward the opening of the outer circumference in order to perform a flushing operation.

Using this configuration, because the absorptive drum is a member separate from the rotational drum, it is possible to absorb the liquid without interfering with the rotation of the rotational drum. Advantages obtained from this configuration will be described below.

In the liquid ejecting apparatus, the absorptive drum may be rotatably supported so that a rotation shaft of the absorptive drum is disposed along a rotation shaft of the rotational drum, and the absorptive drum may receive and absorb the liquid in an area of the outer circumference which is exposed via the opening when the liquid is ejected toward the opening from the nozzles during a flushing operation.

With such a configuration, the area of the outer circumference located at the exposure position when the liquid is ejected toward the opening from the nozzles to perform the flushing is changed by the rotation of the absorptive drum. Accordingly, the distribution of the liquid ejected from the nozzles during a flushing operation can more equally distributed along outer circumference of the absorptive drum. That is, the outer circumference of the absorptive drum can absorb the liquid in a more balanced manner. In consequence, it is possible to absorb the liquid without interfering with the rotation of the rotational drum.

In the liquid ejecting apparatus, the absorptive drum may rotate at an angular velocity which is different from the angular velocity at which the rotational drum is rotated. According to this liquid ejecting apparatus, since the bias to one area absorbing the liquid ejected from the nozzles to perform the flushing can be prevented, the outer circumference of the absorptive drum can absorb the liquid in a more balanced manner.

In the liquid ejecting apparatus, a relative relation between the angular velocities of the absorptive drum and the rotational drum may be set such that upon performing the flushing plural times, the area where the liquid is absorbed during the subsequent flushing operations can be changed.

According to the liquid ejecting apparatus, the area absorbing the liquid ejected from the nozzles to perform the flushing are automatically changed. With such a configuration, the saturation of the area absorbing the liquid ejected from the nozzles to perform the flushing can be prevented, and a more equally distributed absorption in absorptive drum can be achieved. In consequence, it is possible to absorb the liquid without interfering with the rotation of the rotational drum. For example, it is not necessary for a user to manually rotate the absorptive drum to change the area absorbing the liquid ejected from the nozzles to perform the flushing operation.

Liquid Ejection Apparatus According to the Invention

Hereinafter, as an example of a liquid ejecting apparatus according to the invention, an ink jet printer (hereinafter, referred to as a printer 10) will be described.

Configuration of Printer 10

First, the overall configuration of a printer 10 will be described with reference to FIGS. 1 and 2.

FIG. 1 is a schematic perspective view illustrating the printer 10. In FIG. 1, the upward and downward directions of the printer 10 and the movement or scanning direction of heads 31 are indicated by arrows. FIG. 2 is a sectional view illustrating the structure of the sheet holding drum 20 and the peripheral constituent elements thereof. FIG. 2 shows a cross-sectional view which is normal to the central axis of the sheet holding drum 20.

The printer 10 according to this embodiment is an apparatus which is capable of printing an image on a sheet of paper, or other printing medium, by ejecting a liquid, such as an ultraviolet cure ink (hereinafter, referred to as a UV ink) onto the printing medium. The printer 10 performs the printing process in accordance with print data received from a host computer (not shown). The UV ink is ink formed by mixing a mixture of a vehicle, a photopolymerization initiator, and a coloring agent with an aid agent such as an antifoam agent. As shown in FIG. 1, the printer 10 includes a sheet holding drum 20 which comprises a rotational drum, along with a head unit 30 and a UV radiating unit 40. In addition, the printer 10 according to this embodiment includes an absorptive drum 200, as shown in FIG. 2.

Figure 7:
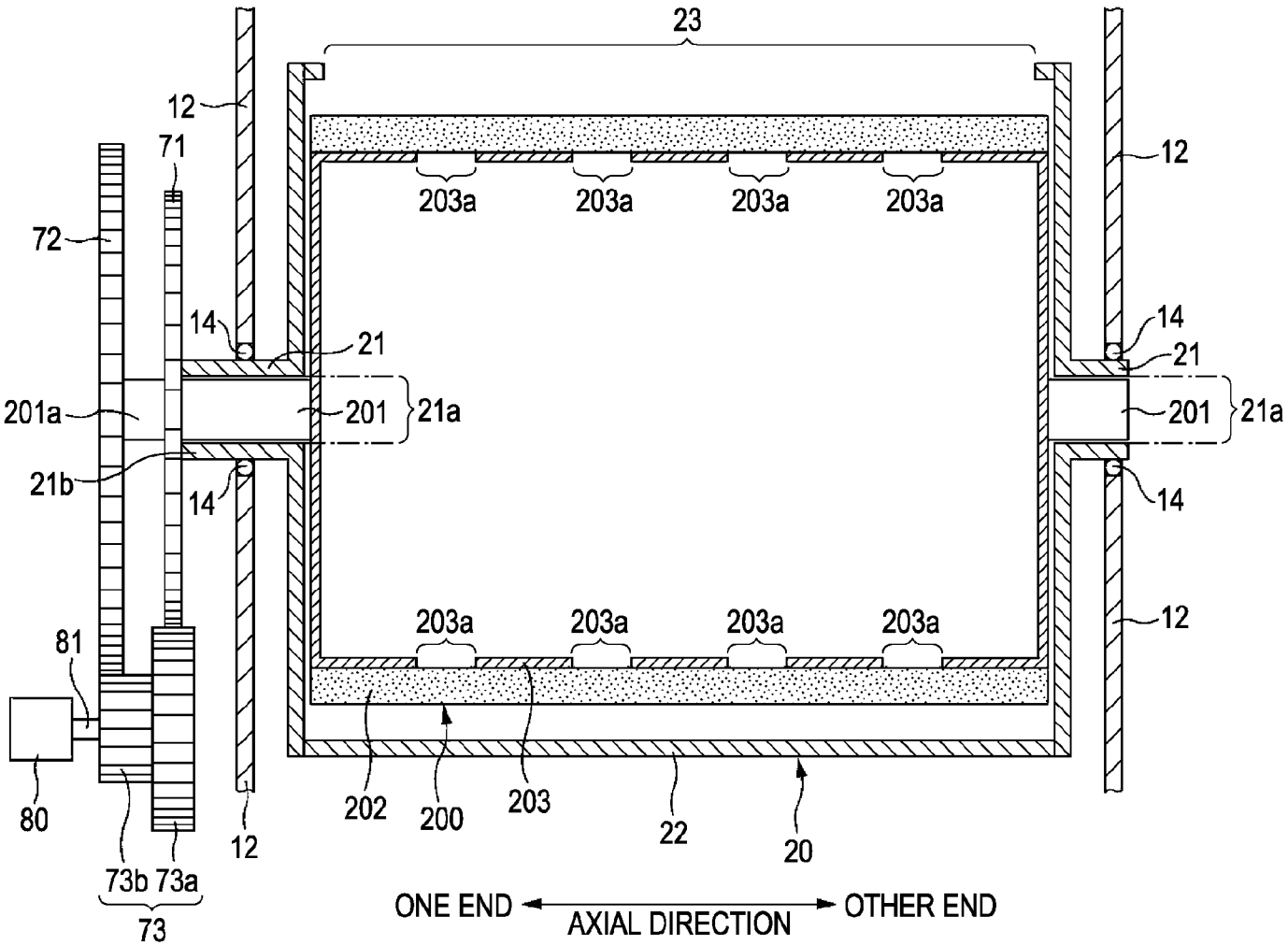
FIG. 7 is an explanatory diagram illustrating the configuration of an absorptive drum.
Figure 8A:
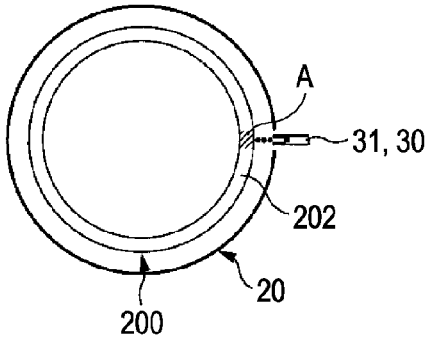
FIGS. 8A to 8G are diagrams illustrating phases in which the absorptive drum absorbs waste ink over a period of time.
Figure 8B:
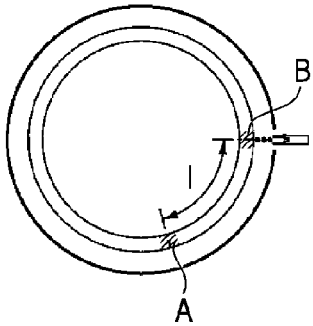
Figure 8C:
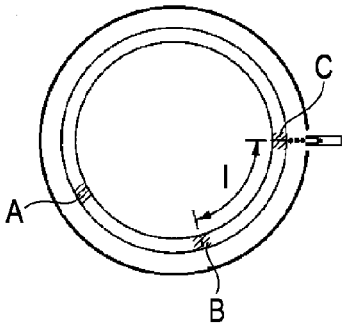
Figure 8D:
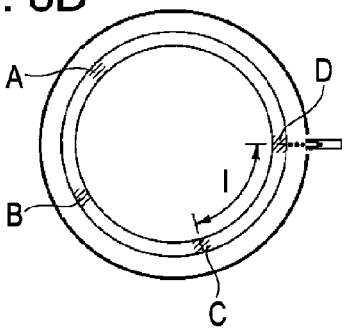
Figure 8E:
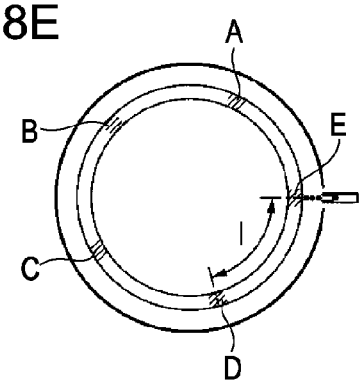
Figure 8F:
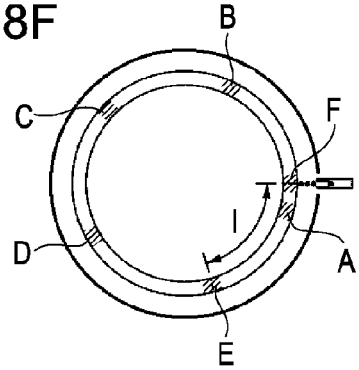
Figure 8G:
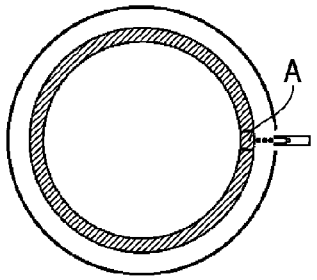

The sheet holding drum 20 is a hollow drum which rotates with a circumferential surface 22 which is capable of holding a sheet. As shown in FIG. 1, the sheet holding drum 20 includes rotation shafts, which are hereinafter referred to as sheet holding drum rotation shafts 21. The sheet holding drum rotation shafts 21 are disposed in both ends of the sheet holding drum 20 in the central axial direction, and are rotatably supported so that the sheet holding drum rotation shafts 21 are supported in a pair of frames 12, so that the rotation shafts 21 are disposed opposite to each other through bearings 14, which are shown in FIG. 7. In addition, the sheet holding drum 20 rotates about the sheet holding drum rotation shafts 21 at a constant angular velocity ω1 in a direction indicated by arrow R in FIG. 1 by receiving a driving force from a driving motor 80, which is shown in FIG. 7.

Figure 2:
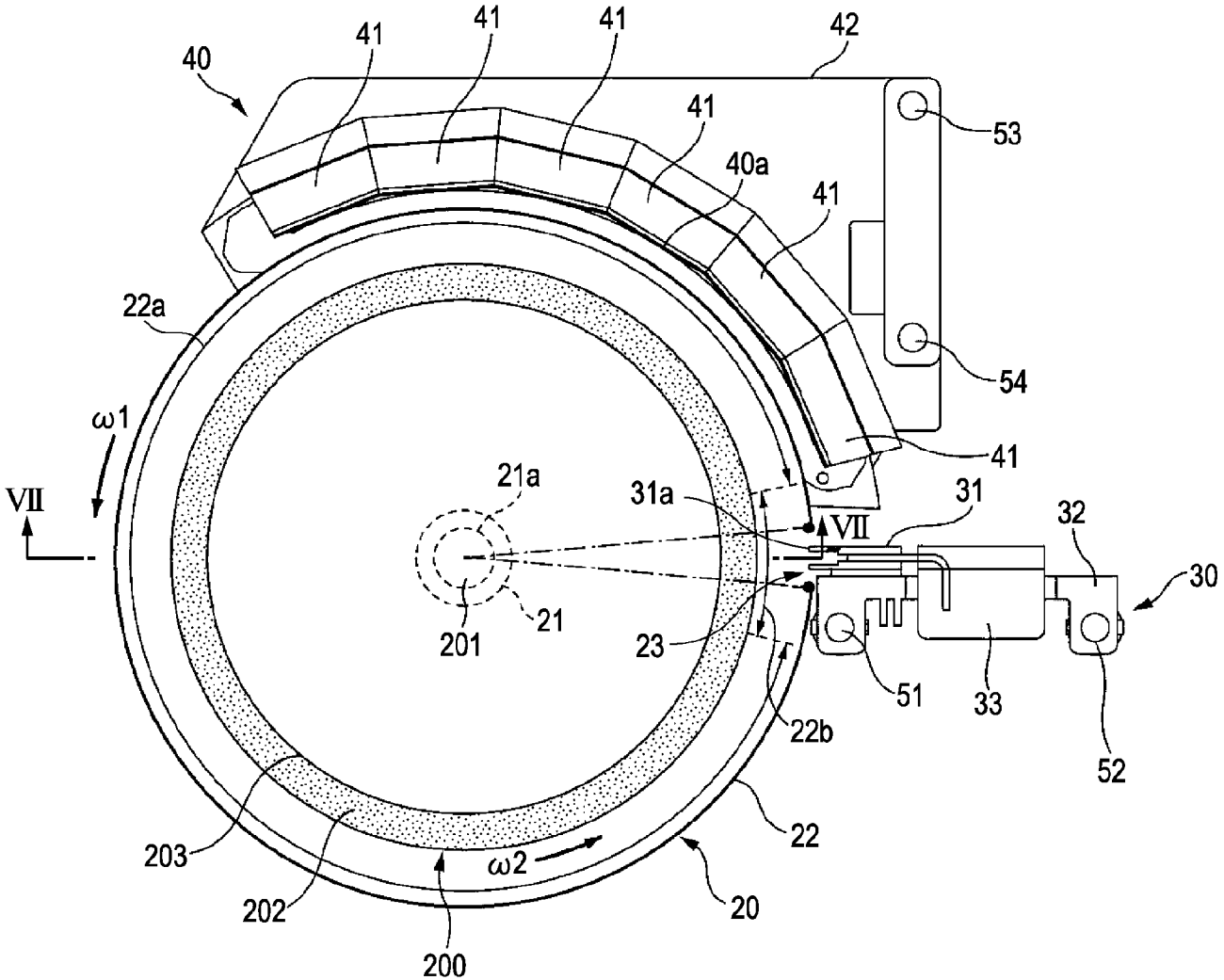
FIG. 2 is a sectional view illustrating the structure of a sheet holding drum and peripheral constituent elements thereof.

As shown in FIG. 2, a holding area 22*a* which holds a sheet and a non-holding area 22*b* which does not hold the sheet constitute the circumferential surface 22 of the sheet holding drum 20. In addition, a substantially rectangular opening 23 is formed in the non-holding area 22*b* with a width which is smaller than the length of the opening in the axial direction of the sheet holding drum 20. As shown in FIG. 2, in this embodiment, the absorptive drum 200 is provided inside the sheet holding drum 20. The absorptive drum 200 will be described more fully below.

The head unit 30 ejects the UV ink onto the sheet held by the holding area 22*a* of the circumferential surface 22 of the sheet holding drum 20. As shown in FIG. 2, the head unit 30 includes the heads 31 and a head carriage 32 mounting the heads 31.

The heads 31 each include a nozzle surface 31*a* where nozzles are formed which faces to the circumferential surface 22 of the sheet holding drum 20. In other words, the sheet holding drum 20 rotates as the circumferential surface 22 facing to the nozzles. The nozzles eject the UV ink onto the sheet held by the circumferential surface 22 of the sheet holding drum 20. The head carriage 32 is supported by guide shafts 51 and 52 formed along the sheet holding drum rotation shafts 21 and reciprocates along the guide shafts 51 and 52. With such a configuration, the heads 31 are configured to reciprocate a shaft direction of the guide shafts 51 and 52 by moving of the head carriage 32. That is, the shaft direction of the guide shafts 51 and 52 corresponds to a movement direction of the heads 31, that is, the scanning direction. As shown in FIG. 2, ink cartridges 33 storing the UV ink are detachably mounted on the head carriage 32.

The UV radiating unit 40 radiates ultraviolet rays toward the UV ink attached onto the sheet. The UV radiating unit 40 is located further downstream in the rotational direction of the sheet holding drum 20 than the head unit 30. In addition, the UV radiating unit 40 includes a plurality lamp units 41 arranged in a row in the rotational direction of the sheet holding drum 20 and a radiating unit carriage 42 which mounts the plurality of lamp units 41.

The plurality of lamp units 41 each has an surface facing to the circumferential surface 22 of the sheet holding drum 20 which radiates the ultraviolet rays emitted from a light source (not shown) from the surface toward the circumferential surface 22 of the sheet holding drum 20. The surfaces of the plurality of lamp units 41 arranged in a row along the rotational direction of the sheet holding drum 20. The plurality of surfaces arranged in the rotational direction of the sheet holding drum 20 individually form radiation surfaces 40*a* equipped to radiate the ultraviolet rays of the UV radiating unit 40. In addition, the sheet holding drum 20 rotates while the circumferential surface 22 faces to the radiation surfaces 40*a*. The radiating unit carriage 42 is supported in the guide shafts 53 and 54 formed along the sheet holding drum rotation shafts 21 and is capable of moving along the guide shafts 53 and 54. With such a configuration, the plurality of lamp units 41 moves in a shaft direction of the guide shafts 53 and 54 by movement of the radiating unit carriage 42.

Nozzles

Figure 3:
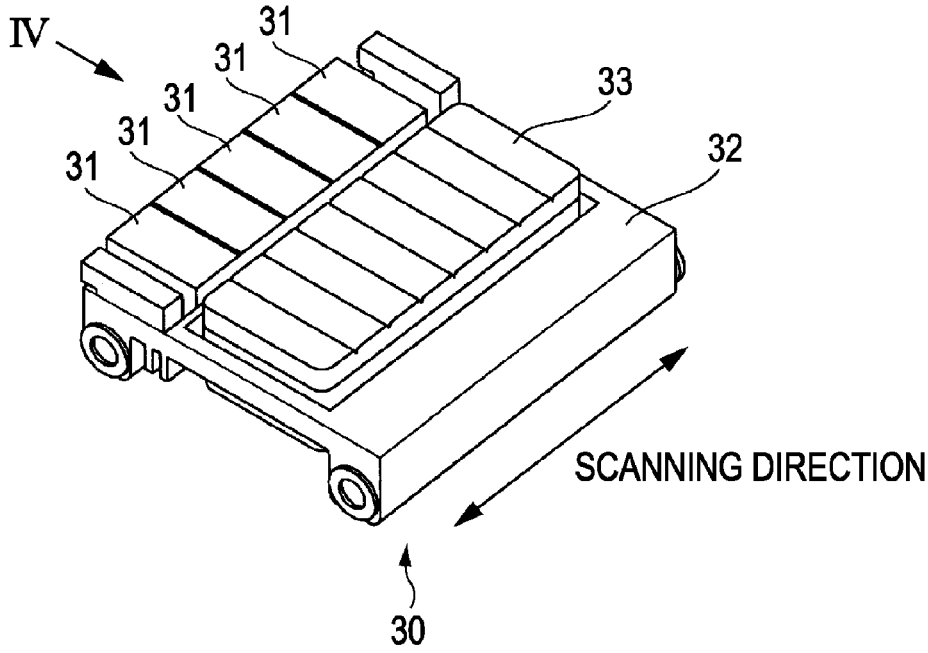
FIG. 3 is a perspective view illustrating a head unit.
Figure 4:
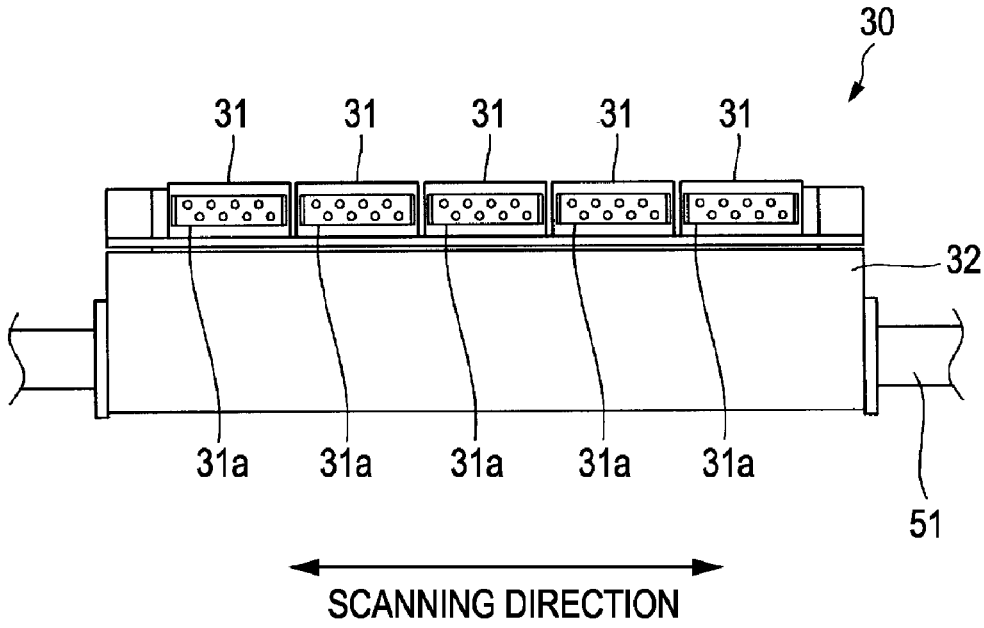
FIG. 4 is a diagram illustrating a nozzle surface.

Next, the nozzles formed in the nozzle surface 31*a* of the heads 31 will be described with reference to FIGS. 3 and 4. FIG. 3 is a perspective view illustrating the head unit 30. FIG. 4 is a diagram illustrating the nozzle surface 31*a* and the head unit 30 is illustrated when viewed from a direction of an arrow IV in FIG. 3. In FIGS. 3 and 4, the scanning direction of the heads 31 is shown.

As shown in FIG. 3, the head unit 30 of this embodiment includes a plurality of heads 31 (5, in this embodiment), which are arranged in a row in the scanning direction. The heads 31 each eject a different kind of UV ink. Specifically, a head 31 capable of ejecting black UV ink, a head 31 capable of ejecting cyan UV ink, a head 31 capable of ejecting magenta UV ink, a head 31 capable of ejecting yellow UV ink, and a head 31 capable of ejecting white UV ink are provided.

As shown in FIG. 4, the plurality of nozzles formed on the nozzle surface 31*a* of each of the heads 31 are arranged in uniform intervals in the scanning direction. Each of the nozzles is provided with an ink chamber (not shown) and a piezo element (not shown). In addition, the ink chamber is expanded or contracted by drive of the piezo element in order to eject ink droplets of the UV ink from each of the nozzles.

UV Radiating Unit 40

Figure 5:
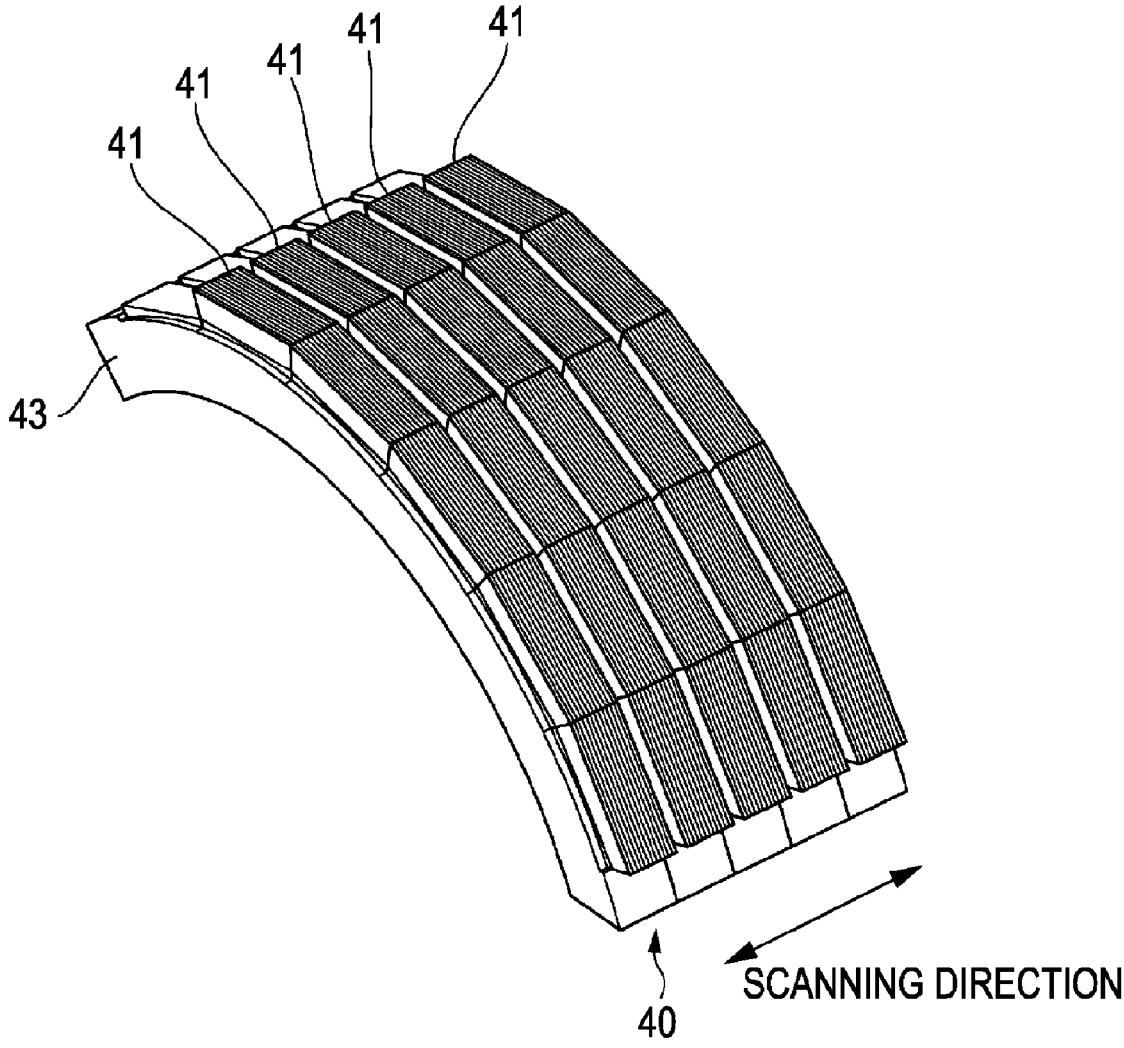
FIG. 5 is a perspective view illustrating a UV radiating unit.

Next, the UV radiating unit 40 will be described with reference FIG. 5. FIG. 5 is a perspective view illustrating the UV radiating unit 40. In FIG. 5, the scanning direction is indicated by the arrow.

The UV radiating unit 40 includes the plurality of lamp units 41 (hereinafter, also referred to as lamp unit rows) arranged in the rotational direction of the sheet holding drum 20, the number of which is the same as that of the heads 31. That is, in this embodiment, a lamp unit row is provided for the black UV ink, cyan UV ink, magenta UV ink, yellow UV ink, and the white UV ink. As shown in FIG. 5, the lamp unit rows are mounted on a common holder 43 and arranged in a row in the scanning direction of the heads 31. With such a configuration, the plurality of radiation surfaces 40*a* individually correspond to the inks arranged in a row in the scanning direction.

As described above, the lamp unit rows are provided so as to correspond to the kinds of UV ink. Therefore, a wavelength and a radiation magnitude of the ultraviolet radiated from each of the lamp units 41 can be set according to the corresponding type of UV ink. In addition, a metal halide lamp, a xenon lamp, a carbon-arc lamp, a chemical lamp, a low-pressure mercury vapor lamp, a high-pressure mercury vapor lamp, or the like may be used as the light source of the lamp units 41.

In this embodiment, the width of each of the radiation surfaces 40*a* in the scanning direction is set to be longer than the width of the nozzle surface 31*a* of each of the heads 31 in the scanning direction.

Configuration of Control Unit 100

Figure 6:
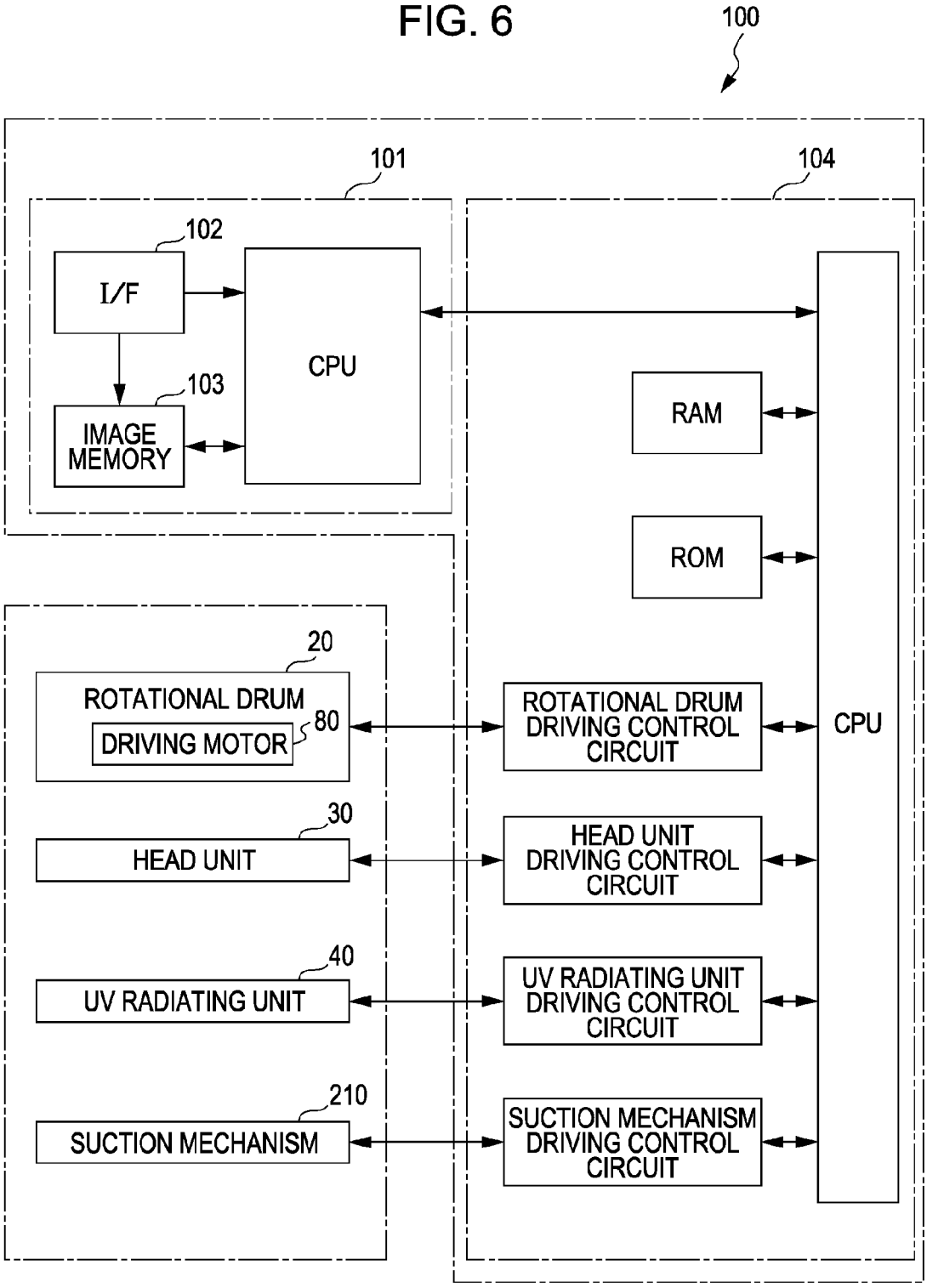
FIG. 6 is a block diagram illustrating a control unit of the printer.

Next, the configuration of the control unit 100 will be described with reference to FIG. 6. FIG. 6 is a block diagram illustrating the control unit 100 of the printer 10.

As shown in FIG. 6, the main controller 101 of the control unit 100 includes an interface 102 which is connected to a host computer and an image memory 103 which is capable of storing image signals input from the host computer.

As shown in FIG. 6, a sub-controller 104 is electrically connected to the constituent elements of the printer main body, the constituent elements comprising the sheet holding drum 20, the head unit 30, the UV radiating unit 40, and the like. In addition, when the sub-controller 104 receives signals from constituent elements equipped with sensors, the sub-controller 104 controls the constituent elements based on the signals input from the main controller 101, while detecting the states of the constituent elements.

Example of Operation of Printer 10

Next, an example of an operation (printing) of printing an image on a sheet by the printer 10 of the above described configuration will be described.

First, when an image signal is input from the host computer to the main controller 101 of the printer 10 through the interface 102, the sub-controller 104 controls the constituent elements of the printer main body based on the command from the main controller 101. Then, the UV radiating unit 40 radiates ultraviolet rays while the sheet holding drum 20 rotates by operating the driving motor 80.

Then, a sheet supplied from a sheet feeding unit 60 is transported to the sheet holding drum 20, and then the sheet is wound around the sheet holding drum 20 so that a surface of the sheet is oriented toward the shaft direction of the sheet holding drum rotation shafts 21. In addition, the sheet is held on the holding area 22*a* by a holding mechanism (not shown) provided in the holding area 22*a* of the circumferential surface 22 of the sheet holding drum 20.

While the sheet is held against and rotates with the circumferential surface 22 of the sheet holding drum 20, the UV ink is ejected from the nozzles of each of the heads 31. The UV ink is lands on a portion of the sheet facing to the nozzle surfaces 31*a* of the heads 31. At this time, since the sheet is rotating, the portion of the sheet facing to the nozzle surfaces 31*a* of the heads 31 changes in the direction intersecting the scanning direction. As such, lines of ejected ink comprising dots are formed along the direction intersecting the scanning direction.

When the portion of the sheet on which the UV ink is landed is moved to the location facing to the radiation surfaces 40*a* of the UV radiating unit 40 by rotation of the sheet, the ultraviolet rays are radiated to the UV ink. In this way, when the UV ink ejected from the nozzles is fixed on the sheet, the ultraviolet rays are immediately radiated to the UV ink and the UV ink is hardened. In consequence, the dot lines formed on the sheet are fixed to the sheet.

Since the lamp unit 41 (more exactly, the lamp unit row) is provided so as to correspond with each of the kinds of UV ink, the UV ink fixed to the sheet is eradiated with the ultraviolet rays from the lamp unit 41 specifically configured for the kinds of UV ink.

In this embodiment, since the plurality of lamp units 41 are arranged in the rotational direction of the sheet holding drum 20 (in other words, since the radiation surfaces 40*a* have a certain length in the rotational direction of the sheet holding drum 20), it is possible to ensure sufficient time in which the portion of the sheet to which the UV ink is fixed faces to the radiation surfaces 40*a*. Therefore, sufficient ultraviolet rays can be radiated to the UV ink fixed to the sheet.

When the non-holding area 22*b* of the circumferential surface 22 of the sheet holding drum 20 reaches the location facing the nozzles by further rotation of the sheet, the heads 31 move in the scanning direction. Subsequently, the operations described above are performed. The, a different color of UV ink is fixed to the color of UV ink previously fixed to and hardened on the sheet. Therefore, the different colors of UV ink are prevented from being mixed, since the previously applied colors of UV ink are already hardened. In addition, as described above, it is necessary to move the heads 31 in the scanning direction during the rotation of the sheet holding drum 20. Therefore, the ink is not ejected from the nozzles toward the non-holding area 22*b* of the circumferential surface 22 of the sheet holding drum 20.

The lamp units 41 move in the scanning direction with the movement of the heads 31 in the scanning direction. With such a configuration, even after the heads 31 move, each of the lamp units 41 radiates the ultraviolet rays to the kind of UV ink corresponding to the lamp unit 41. In addition, the width of each of the radiation surfaces 40*a* is longer than the width of the nozzle surface 31*a* of each of the heads 31. Therefore, even when timing at which the head 31 moves slightly deviates from timing at which the lamp unit 41 moves, sufficient ultraviolet rays can be radiated to the UV ink fixed to the sheet.

When the operations described above are repeatedly performed, the dot lines of respective colors are fixed across an entire image print area of the sheet. In this way, an image is finally printed on the sheet. Subsequently, the sheet on which the image is printed is detached from the sheet holding drum 20 and transported to a sheet discharging unit 62.

Absorption of UV Ink Ejected from Nozzles by Flushing

In this embodiment, flushing is performed in order to continuously eject the appropriate UV ink from the nozzles. The flushing refers to a process of ejecting the UV ink in order to prevent the nozzles from becoming clogged by a buildup of UV ink with an increased viscosity due to evaporation of the solvent in the nozzles.

It is necessary that during the flushing process, the UV ink does not landed to the holding area 22*a* of the circumferential surface 22 of the sheet holding drum 20 and the sheet held on the holding area 22*a*. Therefore, in this embodiment, a flushing process is performed as the nozzles approach the opening 23 formed on the non-holding area 22*b* of the circumferential surface 22 of the sheet holding drum 20. That is, in this embodiment, in order to perform the flushing, the UV ink is configured to be ejected toward the opening 23 from the nozzles.

In this embodiment, the flushing is periodically performed when the sheet holding drum 20 rotates in addition to when the sheet holding drum 20 holds the sheet on the circumferential surface 22, that is, the flushing operation is periodically performed during the printing process. Specifically, when the nozzles approach the opening 23 as the sheet holding drum 20 is rotated, a flushing operation is performed and UV ink is ejected toward the opening 23 from the nozzles.

In this case, after the UV ink (hereinafter, also referred to as waste ink) ejected from the nozzles during the flushing operation passes through the opening 23, the UV ink is collected within the sheet holding drum 20. In order to collect the waste ink, a absorptive drum 200 which is a mechanism capable of collecting the waste ink is provided inside the sheet holding drum 20. Hereinafter, the absorptive drum 200 will be described.

Configuration of Absorptive Drum 200

First, the configuration of the absorptive drum 200 will be described with reference to FIGS. 2 and 7. FIG. 7 is an explanatory diagram illustrating the configuration of the absorptive drum 200 and is a schematic diagram illustrating a cross-section VII in FIG. 2. In FIG. 7, the central axial direction (simply illustrated as an axial direction in FIG. 7) of the sheet holding drum 20 is indicated by an arrow.

The absorptive drum 200 is an absorptive member which absorbs the waste ink passing through the opening 23 and entering the inside of the sheet holding drum 20. In addition, as shown in FIGS. 2 and 7, the absorptive drum 200 is a member wound with a liquid absorbing porous material such as a sponge around the circumferential surface of a drum base portion 203 formed of a cylindrical steel structure, that is, around the entire outer circumference of the drum base portion 203. That is, an inner circumference 202 of the absorptive drum 200 is formed of the liquid absorbing porous material and the absorptive drum 200 absorbs the waste ink entering the inside of the sheet holding drum 20 at the inner circumference 202 thereof.

As shown in FIG. 7, the absorptive drum 200 has rotation shafts (hereinafter, absorptive drum rotation shafts 201) at both the ends in the central axial direction. In addition, the absorptive drum 200 is rotatably supported inside the sheet holding drum 20 so that the absorptive drum rotation shafts 201 of the absorptive drum 200 are disposed along the sheet holding drum rotation shafts 21.

Specifically, through-holes 21*a* are formed in the sheet holding drum rotation shafts and have a diameter that is larger than the outer diameter of the absorptive drum rotation shafts 201. In addition, the absorptive drum rotation shafts 201 inserted into the through-holes 21*a* are supported in the sheet holding drum rotation shafts 21 so that the absorptive drum rotation shafts 201 relatively rotate with respect to the sheet holding drum rotation shafts 21. With such a configuration, the absorptive drum 200 can rotate with respect to the sheet holding drum 20.

When the absorptive drum rotation shafts 201 are supported in the sheet holding drum rotation shafts 21, the center of the absorptive drum rotation shafts 201 substantially accords with the center of the sheet holding drum rotation shafts 21. That is, when the absorptive drum rotation shafts 201 are supported in the sheet holding drum rotation shafts 21, the cross-section of the outer circumference 202 of the absorptive drum 200 and the cross-section of the circumferential surface 22 of the sheet holding drum 20 are concentric with each other, as shown in FIG. 2.

A front end portion 201*a* of the absorptive drum rotation shaft 201 located in one end in the central axial direction of the sheet holding drum 20 protrudes toward the outside of the sheet holding drum rotation shaft 21 from the through-hole 21*a* when the absorptive drum 200 is supported inside the sheet holding drum 20, as shown in FIG. 7. An absorptive drum gear 72 is attached to the front end portion 201*a* of the absorptive drum rotation shaft 201, as shown in FIG. 7. In addition, a sheet holding drum gear 71 is attached to a front end portion 21*b* of the sheet holding drum rotation shaft 21 located in one end in the central axial direction of the sheet holding drum 20.

The sheet holding drum gear 71 and the absorptive drum gear 72 engage together with a gear attached to a driving shaft 81 of the driving motor 80. Specifically, a compound gear 73 including a first driving gear 73*a* which engages with the sheet holding drum gear 71 and a second driving gear 73*b* which engages with the absorptive drum gear 72 is attached to the driving shaft 81.

Using this configuration, when the driving motor 80 operates to rotate the driving shaft 81, both the sheet holding drum 20 and the absorptive drum 200 rotate. That is, in this embodiment, a common driving motor 80 is provided in order to rotate both the sheet holding drum 20 and the absorptive drum 200. Therefore, the absorptive drum 200 according to this embodiment rotates at a constant angular velocity during the rotation of the sheet holding drum 20.

In this embodiment, the tooth number (or ratio between gears engaging with each other) of each of the sheet holding drum gear 71, the absorptive drum gear 72, the first driving gear 73*a*, and the second driving gear 73*b* is set so that the absorptive drum 200 rotates at the angular velocity different from that of the sheet holding drum 20. Therefore, while the sheet holding drum 20 rotates at an angular velocity $\omega 1$, the absorptive drum 200 rotates at an angular velocity $\omega 2$ different from the angular velocity $\omega 1$ in a direction indicated by an arrow in FIG. 2. Here, a relative relation between the angular velocities ω1 and ω2 is set such that the absorptive drum 200 rotates by f/k of one time rotation (where f and k are disjoint and f/k is set to 99/125 in this embodiment) when the sheet holding drum 20 rotates one time.

The waste ink passing through the opening 23 and entering the inside of the sheet holding drum 20 is absorbed by the absorptive drum 200 (more exactly, by the outer circumference 202 of the absorptive drum 200) having the above configuration.

More specifically, when the nozzles approach the opening 23 with the rotation of the sheet holding drum 20, the UV ink is ejected toward the opening 23 from the nozzles to perform a flushing process, as described above. At this time, an area located at the exposure position exposed through the opening 23 in the outer circumference 202 of the absorptive drum 200 receives the UV ink (that is, the waste ink). Then, the UV ink is absorbed and maintained in the above area.

Here, the area located at the exposure position refers to an area inside the outer circumference 202 of the absorptive drum 200, which is partitioned by two imaginary planes (indicated the dotted line shown in FIG. 2) oriented from the rotation center of the sheet holding drum 20 toward each end of the opening 23 in the rotational direction of the sheet holding drum 20.

In this embodiment, in order to continually absorb the waste ink in the absorptive drum 200, a suction mechanism 210 (see FIG. 6) is provided inside the drum base portion 203. In addition, as shown in FIG. 7, air holes 203*a* are provided on the circumferential surface of the drum base portion 203 in order for the suction mechanism 210 to suck the air from the outside of the absorptive drum 200.

When the suction mechanism 210 sucks the air from the outside of the absorptive drum 200 through the air holes 203*a*, the air is ventilated more easily in the outer circumference 202 of the absorptive drum 200 and thus a solvent of the waste ink absorbed to the outer circumference 202 is evaporated more easily. As a result, it is possible to sustain the absorption capability of the absorptive drum 200. In addition, the suction mechanism 210 is controlled by the sub-controller 104 through a suction mechanism driving control circuit. The suction mechanism 210 normally continues to operate during the rotation of the sheet holding drum 20 and the absorptive drum 200.

Operation Example of Absorptive Drum 200

Next, an example of the operation of the absorptive drum 200, or more specifically, a method of absorbing the waste ink by use of the absorptive drum 200 will be described with reference to FIGS. 8A to 8G. FIGS. 8A to 8G are diagrams illustrating phases in which the absorptive drum 200 absorbs the waste ink over a period of time. In addition, the phases of the absorptive drum 200 transitions in order of FIGS. 8A, 8B, 8C, 8D, 8E, 8F, and 8G.

In this embodiment, as described above, the flushing is periodically performed during the rotation of the sheet holding drum 20. In particular, in this embodiment, during the rotation of the sheet holding drum 20, the UV ink is ejected from the nozzles in order to perform the flushing process whenever the nozzles approach the opening 23 as the sheet holding drum 20 is rotated. The UV ink (that is, the waste ink) ejected from the nozzles during the flushing process is received in the area located at the exposure position in the outer circumference 202 of the absorptive drum 200 and is absorbed to the area.

In this embodiment, while the sheet holding drum 20 rotates at the angular velocity ω1, the absorptive drum 200 rotates at the angular velocity ω2, which is different from the angular velocity ω1 of the sheet holding drum 20. Due to the difference between the angular velocities of the sheet holding drum 20 and the absorptive drum 200, the area located at the exposure position in the outer circumference 202 of the absorptive drum 200 is different each time the UV ink is ejected from the nozzles during a flushing process.

The details will be described in detail below. In addition, in the below description, when the sheet holding drum 20 rotates several times, that is, it is assumed that the flushing is performed several times in the following description. For easy description, it is assumed that the sheet holding drum 20 rotates a plurality of times without interruption and that the waste ink is not absorbed in the outer circumference 202 of the absorptive drum 200 when the sheet holding drum 20 starts to rotate.

When the sheet holding drum 20 starts to rotate, the nozzles initially approach the opening 23, and the flushing is performed for the first time. At this time, the UV ink is ejected toward the opening 23 from the nozzles toward the outer circumference 202 of the absorptive drum 200 at an exposure area A indicated by hatching in FIG. 8A. Then, the absorptive drum 200 absorbs the waste ink by receiving the waste ink ejected from the nozzles in the area A.

Subsequently, when the sheet holding drum 20 rotates one time, the nozzles once again approach the opening 23, and the flushing is performed a second time. During the interval since the first flushing process was performed, the absorptive drum 200 has been rotated at the angular velocity ω2, which is different than the rate of rotation of the sheet holding drum 20. Consequently, a different area of the absorptive drum 200 is located at the exposure position when the UV ink is ejected toward the opening 23 from the nozzles during the second flushing operation.

More specifically, the area B of the outer circumference 202 of the absorptive drum 200 located at the exposure position when the UV ink is ejected toward the opening 23 from the nozzles during the second flushing operation is different from the area A. In this embodiment, the absorptive drum 200 rotates one 99/125 rotation for each rotation of the sheet holding drum 20. Therefore, an interval (herein referred to as interval 1) between the center of the area A and the center of the area B in the rotational direction is 26/125 of the outer circumference of the absorptive drum 200 in the reverse rotational direction. That is, the area B which absorbs the waste ink ejected from the nozzles during the second flushing operation is deviated from the area A where the ink is ejected from the nozzles in the first flushing operation.

Subsequently, whenever the sheet holding drum 20 rotates one time, the UV ink is ejected toward the opening 23 from the nozzles. In addition, the area absorbing the waste ink ejected from the nozzles during a flushing operation is deviated by the interval 1 from the area which absorbs the waste ink in the previous flushing process, as shown in FIGS. 8C to 8F.

In other words, in this embodiment, a relative relation between the angular velocity ω1 of the sheet holding drum 20 and the angular velocity ω2 of the absorptive drum 200 is set such that the area of the outer circumference 202 located at the exposure position when the UV ink is ejected toward the opening 23 changes by a certain interval in the rotational direction of the absorptive drum 200 during every flushing process.

The UV ink absorbed in the exposure position when the UV ink is ejected toward the opening 23 from the nozzles during a flushing operation is held in the absorptive drum 200. More specifically, because the UV ink is restrained inside the outer circumference 202 of the absorptive drum 200 when ultraviolet rays radiated from the UV radiating unit 40 penetrate from the opening 23 to the inside of the sheet holding drum 20, the ultraviolet rays reach the UV ink absorbed in the area, and harden the UV ink.

In this way, the absorptive drum 200 continues to absorb the waste ink by allowing the area absorbing the waste in the outer circumference 202 to change to a previously unused area during each flushing process until the flushing is performed 125 times. Subsequently, when the UV ink is ejected toward the opening 23 from the nozzles to perform the flushing 126th time, the area A located at the exposure position returns to the area A. Thereafter, in the sequence described above, the area located at the exposure position is deviated by the certain interval in the rotational direction of the absorptive drum 200.

With such a configuration, there are 125 different areas in the rotational direction of the absorptive drum 200 which are capable of equally absorbing the waste ink. In consequence, it is possible to absorb more waste ink, compared to a case where only a certain area of the outer circumference 202 of the absorptive drum 200 is used to absorb the waste ink.

In this embodiment, as an example of the relative relation between the angular velocity ω1 of the sheet holding drum 20 and the angular velocity ω2 of the absorptive drum 200, the absorptive drum 200 rotates one 99/125 of a rotation each time the sheet holding drum 20 rotates one time. However, the invention is not limited thereto. The absorptive drum 200 may rotate f/k times (where f and k are disjoint) each time the sheet holding drum 20 rotates one time. In addition, an amount of the waste ink absorbed by the outer circumference 202 of the absorptive drum 200 may increase more with as k increases.

Advantage of Printer 10 in Embodiment

Figure 9:
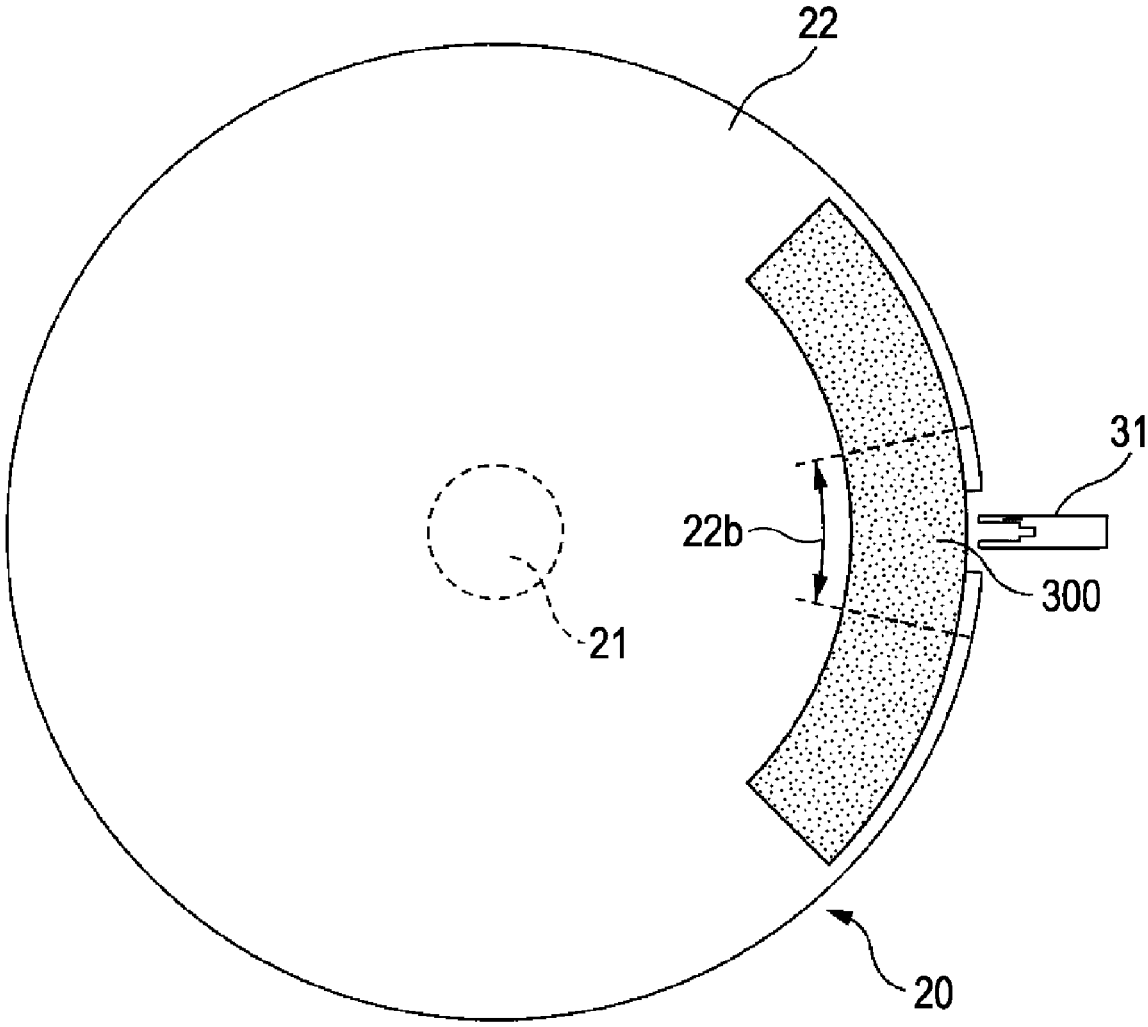
FIG. 9 is a diagram illustrating printing apparatus currently known in the art.

The printer 10 according to this embodiment includes nozzles which eject the UV ink on a sheet; the sheet holding drum 20 which has a circumferential surface 22 having both the holding area 22*a* for holding the sheet and the non-holding area 22*b* provided with the opening 23, the circumferential surface 22 being capable of rotating which a portion of the circumferential surface 22 faces the nozzles; and a absorptive drum 200 which is provided inside the sheet holding drum 20 which is capable of absorbing the waste ink ejected toward the opening 23 from the nozzles in order to perform a flushing operation at the outer circumference 202. With such a configuration, it is possible to absorb the waste ink without interfering with the rotation of the sheet holding drum 20. Such advantages will be described with reference to FIG. 9. FIG. 9 is a diagram illustrating a comparative example to explain the advantages of the printer 10 in an embodiment.

As described in the "BACKGROUND OF THE INVENTION", when an absorptive member is provided for absorbing the waste ink ejected from the nozzles to perform flushing in a printing apparatus currently known in the art, the absorption of the waste ink by the absorptive member may affect the rotation of the sheet holding drum 20. For example, when an absorptive member 300 shown in FIG. 9 is attached to the sheet holding drum 20, the absorptive member 300 rotates integrally with the sheet holding drum 20. The absorptive member 300 formed of an absorbing porous material, such as a sponge, is attached to the sheet holding drum 20 in such that the absorptive member 300 is fitted into a groove formed in an axial direction of the sheet holding drum 20 in the non-holding area 22*b* of the circumferential surface 22 of the sheet holding drum 20, as shown in FIG. 9.

With such a configuration, since the absorptive member 300 rotates integrally with the sheet holding drum 20, the sheet holding drum 20 rotates while the absorptive member 300 absorbs the waste ink at the location where the absorptive member 300 is attached to the sheet holding drum 20. That is, the waste ink is absorbed locally at the location where the absorptive member 300 is attached to the sheet holding drum 20. As shown in FIG. 9, the length of the absorptive member 300 in the rotational direction of the sheet holding drum 200 is configured to be longer than the length of the opening 23. Therefore, the waste ink absorbed to the absorptive member 300 through the opening 23 is not absorbed to the entire absorptive member 300 but absorbed only by a portion of the absorptive member 300 approaching the opening 23.

When the waste ink continues to be absorbed by the absorptive member 300, the weight balance of the sheet holding drum 20 may change. The change in the weight balance of the sheet holding drum 20 causes the rotation of the sheet holding drum 20 to be disturbed, thereby interfering with the rotation of the sheet holding drum 20.

In the apparatus described herein, however, the absorptive drum 200 equipped inside the sheet holding drum 20 is provided as a member absorbing the waste ink. That is, the sheet holding drum 20 and the absorptive drum 200 absorbing the waste ink are separately provided. With such a configuration, it is possible to solve the problem occurring when the sheet holding drum 20 and the absorptive member 300 are incorporated with each other.

Specifically, since the sheet holding drum 20 and the absorptive drum 200 are separately provided, it is possible to independently rotate only the sheet holding drum 20 by separately providing a driving motor rotating the sheet holding drum 20 and a driving motor rotating the absorptive drum 200. In consequence, the absorptive drum 200 absorbing the waste ink is separated from the sheet holding drum 20. Using this configuration, the sheet holding drum 20 can rotate without receiving an influence occurring when the absorptive drum 200 absorbs the waste ink. More specifically, the sheet holding drum 20 can rotate without a change in the weight balance of the sheet holding drum 20. Accordingly, it is possible to absorb the waste ink without interfering with the rotation of the sheet holding drum 20.

Alternatively, the absorptive drum 200 may also be rotatably supported inside the sheet holding drum 20 with a single driving motor 80 rotating both the absorptive drum 200 and the sheet holding drum 20. That is, an additional configuration in which the absorptive drum 200 rotates together with the rotation of the sheet holding drum 20 may be used. With such a configuration, it is also possible to absorb the waste ink without interfering with the rotation of the sheet holding drum 20.

When the single driving motor 80 rotates both the absorptive drum 200 and the sheet holding drum 20 in the apparatus currently used in the art, the absorptive drum 200 and the sheet holding drum 20 each have a gear (that is, the sheet holding drum gear 71 or the absorptive drum gear 72) which engages the compound gear 73. With such a configuration, the rotation of the absorptive drum 200 and the rotation of the sheet holding drum 20 may affect each other. In addition, when the waste ink is absorbed locally in the outer circumference 202 of the absorptive drum 200, the weight balance of the absorptive drum 200 may collapse, thereby causing the rotation of the absorptive drum 200 to be disturbed. The disturbance of the rotation of the absorptive drum 200 may be delivered to the sheet holding drum 20 through the compound gear 73, thereby resulting in disturbing the rotation of the sheet holding drum 20. In this way, when the waste ink is absorbed locally in the outer circumference 202 of the absorptive drum 200, the trouble with the rotation of the sheet holding drum 20 may be caused.

However, in the embodiments described herein, even when the single driving motor 80 rotates both the absorptive drum 200 and the sheet holding drum 20, it is possible to prevent the waste ink from being absorbed locally in the outer circumference 202 of the absorptive drum 200 by separately providing both the absorptive drum 200 and the sheet holding drum 20 and rotatably supporting both the absorptive drum 200 and the sheet holding drum 20.

Specifically, by rotating the absorptive drum 200, the area of the outer circumference 202 of the absorptive drum 200 located at the exposure position when the UV ink is ejected toward the opening 23 from the nozzles during a flushing operation is changed. In this way, since the area absorbing the waste ink in the outer circumference 202 of the absorptive drum 200 changes (deviates) in the rotational direction of the absorptive drum 200, it is possible to prevent the waste ink from being absorbed locally.

More specifically, in this embodiment, a relative relation between the angular velocities of the sheet holding drum 20 and the absorptive drum 200 is set such that when a flushing operation is performed a plurality of times, the area of the outer circumference 202 located at the exposure position when the UV ink is ejected from the nozzles is constantly changing and is equally distributed along the absorptive drum 200.

With such a configuration, it is possible to prevent the waste ink from being absorbed disproportionately in the outer circumference 202 of the absorptive drum 200 and to prevent the rotation of the absorptive drum 200 from being disturbed, as described above. Consequently, it is possible to absorb appropriate waste ink without interfering with the rotation of the sheet holding drum 20. In addition, when the relative relation between the angular velocities of the sheet holding drum 20 and the absorptive drum 200 is set to the above-described relation, the area of the outer circumference 202 absorbing the waste ink increases and thus an amount of waste ink absorbed to the outer circumference 202 may be increased.

When the relative relation between the angular velocities of the sheet holding drum 20 and the absorptive drum 200 is set to the above-described relation, the area of the outer circumference 202 of the absorptive drum 200 which absorbs the waste ink automatically changes during the rotation of the sheet holding drum 20. However, in the configuration in which the absorptive drum 200 is rotatably supported inside the sheet holding drum 20, the area absorbing the waste ink may be also changed by allowing a user to relatively rotate the absorptive drum 200 in a manual manner with respect to the sheet holding drum 20 when the sheet holding drum 20 stopped, even when the relative relation is set to a relation (that is, in which the angular velocity $\omega 2$ of the absorptive drum 200 is the integral multiple of the angular velocity $\omega 1$ of the sheet holding drum 20). However, when the relative relation between the angular velocities of the absorptive drum 200 and the sheet holding drum 20 is set to the relation described above, as in this embodiment, it is not necessary for the user to change the area absorbing the waste ink in a manual manner.

In this embodiment, whenever the nozzles approach the opening 23 with the rotation of the sheet holding drum 20 (that is, whenever the nozzles approach the opening 23 and the sheet holding drum 20 rotates one time), the UV ink is ejected toward the opening 23 from the nozzles to perform a flushing operation. On the other hand, the absorptive drum 200 rotates by f/k (99/125) of a rotation for each rotation of the sheet holding drum 20. In consequence, in this embodiment, the relative relation between the angular velocities of the sheet holding drum 20 and the absorptive drum 200 is set such that the area located at the exposure position changes by the interval 1 in the rotational direction of the absorptive drum 200 in each subsequent flushing operation (see FIGS. 8A to 8G).

In this embodiment, the waste ink can be equally distributed to and absorbed by the outer circumference 202 of the absorptive drum 200. Specifically, the waste ink can be evenly absorbed to k (125) different areas of the outer circumference 202 of the absorptive drum 200. In this way, it is possible to effectively prevent the rotation of the absorptive drum 200 from being disturbed. In consequence, it is possible to more effectively prevent the rotation of the sheet holding drum 20 from being disturbed and more effectively stabilize the rotation of the sheet holding drum 20.

Other Embodiments

The printer 10 as an example of a liquid ejecting apparatus has been described mainly on the basis of the above-described configuration. However, the embodiment of the invention has been described for easy understanding of the invention and is not considered as limiting. The invention may be modified and improved without deviating from the scope and meaning of the claims.

The ink jet printing apparatus described above ejects UV ink, but the invention is not limited thereto. Other liquid ejecting apparatuses capable of ejecting a liquid, liquid-formed substances in which particles of a functional material are dispersed, fluid-formed substances such as gel, or solids which flow and are ejected as liquid may also be used. Examples of the liquid ejecting apparatuses include liquid ejecting apparatuses capable of ejecting a liquid-formed substance in which a material such as an electrode material or a coloring material is used to manufacture a liquid display device, an EL (electroluminescence) display device, and a plane emission display is dispersed or solved; liquid ejecting apparatuses capable of ejecting a bio organic material used to manufacture a bio chip; and liquid ejecting apparatuses capable of ejecting a liquid as a sample used by a precise pipette. In addition, the apparatus may comprise a liquid ejecting apparatus capable of ejecting a lubricant to a precision instrument such as a clock or a camera by a pin point; a liquid ejecting apparatus capable of ejecting a transparent resin liquid such as ultraviolet cured resin on a substrate to form a minute hemispheric lens (optical lens) used in an optical communication element or the like; a liquid-formed substance capable of ejecting apparatus ejecting gel; and a fine particle ejection type recording apparatus capable of ejecting a solid such as a fine particle such as toner may also be used.

What is claimed is:

1. A liquid ejecting apparatus comprising:

nozzles capable of ejecting a liquid onto a medium;

a rotational drum including a circumferential surface having a holding area for holding the medium and a non-holding area provided with an opening, wherein the circumferential surface rotates while facing the nozzles; and an absorptive drum which is provided inside the rotational drum which is capable of absorbing the liquid ejected from the nozzles toward the opening of the outer circumference in order to perform a flushing operation, wherein the absorptive drum is rotatably supported so that a rotation shaft of the absorptive drum is disposed along a rotation shaft of the rotational drum, wherein the absorptive drum receives and absorbs the liquid at an exposure position which exposed to the nozzles by the opening of the circumferential surface of the rotational drum when the liquid is ejected toward the opening from the nozzles during the flushing operation, and wherein the absorptive drum rotates at an angular velocity which is different than the angular velocity at which the rotational drum rotates.

2. The liquid ejecting apparatus according to claim 1, wherein a relative relation between the angular velocities of the absorptive drum and the rotational drum is set such that upon performing the flushing a plurality times, the exposure position which absorbs the liquid ejected from the nozzles in a first flushing operation is different than the exposure position which absorbs the liquid ejected from the nozzles in a second flushing operation.

3. The liquid ejecting apparatus according to claim 2, wherein the relative relation between the angular velocities of the absorptive drum and the rotational drum is set such that the exposure position which absorbs the liquid ejected from the nozzles changes by a certain interval in the rotational direction each time a flushing operation is performed.

4. A method of performing a flushing operation in a liquid ejecting apparatus including nozzles capable of ejecting a liquid onto a medium, a rotational drum including a circumferential surface having a holding area for holding the medium and a non-holding area provided with an opening, and an absorptive drum which is provided inside the rotational drum, the method comprising:

rotating the rotational drum so that the circumferential surface faces the nozzles until the nozzles face the opening of the non-holding area of the outer circumference;

rotating the absorptive drum at an angular velocity which is different than an angular velocity at which the rotational drum is rotated;

ejecting the liquid toward the opening from the nozzles; and absorbing the liquid at an exposure position of the absorptive drum which exposed to the nozzles by the opening of the circumferential surface of the rotational drum.

5. The method according to claim 4, wherein a relative relation between the angular velocities of the absorptive drum and the rotational drum is set such the exposure position which absorbs the liquid ejected from the nozzles in a first flushing operation is different than the exposure position which absorbs the liquid ejected from the nozzles in a second flushing operation.

6. The method according to claim 5, wherein the relative relation between the angular velocities of the absorptive drum and the rotational drum is set such that the exposure position which absorbs the liquid ejected from the nozzles changes by a certain interval in the rotational direction each time a flushing.

* * * * *